US009822770B2

(12) United States Patent
Pabst

(10) Patent No.: US 9,822,770 B2
(45) Date of Patent: Nov. 21, 2017

(54) PUMP FOR TRANSFER OF LIQUIDS CONTAINING SUSPENDED SOLIDS

(71) Applicant: Kirby Norman Pabst, Onalaska, WI (US)

(72) Inventor: Kirby Norman Pabst, Onalaska, WI (US)

(73) Assignee: THE BROTHERS DIETRICH, Onalaska, WI (US)

( * ) Notice: Subject to any disclaimer, the term of this patent is extended or adjusted under 35 U.S.C. 154(b) by 0 days.

(21) Appl. No.: 13/621,502

(22) Filed: Sep. 17, 2012

(65) Prior Publication Data

US 2014/0079573 A1 Mar. 20, 2014

(51) Int. Cl.

| | |
|---|---|
| ***F04B 7/02*** | (2006.01) |
| ***F04B 43/08*** | (2006.01) |
| ***F04B 43/00*** | (2006.01) |

(52) U.S. Cl.

CPC ..... *F04B 7/02* (2013.01); *F04B 43/0072* (2013.01); *F04B 43/08* (2013.01); *F04B 43/084* (2013.01)

(58) Field of Classification Search

CPC .... F04B 43/1133; F04B 43/08; F04B 43/084; F04B 45/02–45/027; F04B 45/003–45/0336; F04B 7/02; F04B 7/0266; F04B 7/0275; F04B 43/0072

USPC .. 417/472, 473, 474–477.14, 480, 507, 558; 137/107, 614.2

See application file for complete search history.

(56) References Cited

U.S. PATENT DOCUMENTS

| | | | | |
|---|---|---|---|---|
| 4,256,130 | A * | 3/1981 | Smith et al. | 137/1 |
| 4,880,185 | A * | 11/1989 | Apfel | 244/135 B |
| 5,336,051 | A * | 8/1994 | Tamari | 417/19 |
| 6,311,950 | B1 * | 11/2001 | Kappel | F02M 51/0603 251/129.06 |
| 7,320,457 | B2 * | 1/2008 | Heim et al. | 251/129.06 |
| 8,033,801 | B2 * | 10/2011 | Kato et al. | 417/472 |
| 2004/0149942 | A1 * | 8/2004 | Lehnhardt | E04G 21/04 251/5 |
| 2006/0292018 | A1 * | 12/2006 | Jones | 417/397 |
| 2007/0209704 | A1 * | 9/2007 | Ho et al. | 137/107 |
| 2009/0324431 | A1 * | 12/2009 | van Boeyen et al. | 417/379 |

* cited by examiner

*Primary Examiner* — Peter J Bertheaud
*Assistant Examiner* — Dnyanesh Kasture
(74) *Attorney, Agent, or Firm* — Casimir Jones S.C.

(57) ABSTRACT

A liquid transfer pump comprises a bellows-type chamber retractable and extendable by a reciprocating drive. The pump is fed by feed stock inflow controlled by a flexible tubular pinch-type valve, and propelled out of the chamber through an identical pinch-type valve. Quick pneumatic relief valves mounted directly on the pinch-type valves ensure instantaneous opening of the pinch-type valves thereby regulating liquid flow. Synchronous regulation of pump cycles is maintained by computer or microprocessor control.

3 Claims, 8 Drawing Sheets

PUMP FOR TRANSFER OF LIQUIDS CONTAINING SUSPENDED SOLIDS

CROSS-REFERENCE TO RELATED APPLICATIONS

None

STATEMENT REGARDING FEDERALLY SPONSORED RESEARCH OR DEVELOPMENT

None

BACKGROUND OF THE INVENTION

In the transfer of liquids from a source to a desired receptacle at a more or less remote location, unusual challenges are presented when the liquid to be transferred is not of uniform composition, has insoluble contaminants or is comprised of suspended solids that tend to settle out of solution. The situation is exacerbated when pump cycles are discontinuous and the pump is idle long enough to allow sediment to clog pump internal moving parts. In most applications, it is impractical to flush the transfer lines and pump components between pump cycles. Similar problems arise even when solids are comminuted or when viscosity is great enough to cause stress on moving pump components. One particularly vexing problem is the tendency for some solutions of otherwise perfectly soluble chemicals to precipitate crystals which clog outlets and interfere with the operation of ball values, spring leaded check valves, and the like.

The type of pump selected for a particular application is dictated by the nature of the application. Selection must take into account both the mechanism propelling liquid, but also the design of the valves creating the unidirectional flow. For example, the bellows-type component of the instant pump is an excellent source of measurement and propulsion, but if conventional duckbill valves are employed, especially in vertical orientation, the cavities surrounding the duckbill quickly plug, and the valve will not open.

In general, conventional valves of the paddle, vane, or flexible vane type are not suitable for transferring liquids having high sediment content. Between pump cycles, sediment accumulates on the floor of the valve impeding flow in subsequent cycles. Even the flexible vane embodiment, while avoiding complete plugging because of flexing over sediment deposits, nevertheless will give inaccurate delivery volumes if relying on lapsed time records, and would require real time volumetric determinations.

U.S. Pat. No. 4,445,823 discloses a transfer system for manure and other barn waste (one of the applications to which the present invention is particularly well suited). It describes a powered shaft upon which is mounted a hollow piston urged up and down in a collection hopper to effect agitation and create a pumping action. Although much of the transfer flow is affected by gravity, agitation is beneficial in that it largely prevents a heavy scum from forming on the surface of the liquid, and also prevents stagnation in the upper levels of the hopper.

Another approach to pumping heterogeneous liquids is disclosed in U.S. Pat. No. 4,773,834, and consists of a screw-like transfer of materials in a feedstock through a progressive cavity pump. The screw has helical continuous depressions sealed by a pliant filler contained within a rigid housing. Material is moved by rotating the screw in an upwardly direction to physically translate the material from the entry to the exit point. This device is suitable for conveying both mixed content liquids as well as dry solids. A still further approach is disclosed in U.S. Pat. No. 7,553,124 for a centrifugal pump having one or two recessed impellers; or one or two-disk type impellers, or a combination of one recessed and one disk-type. The pump is designed for high viscosity liquids, slurries, and liquids with solids. One advantage is a lack of dead space in the pump chamber. U.S. Pat. No. 7,321,753 describes an interesting secondary pumping device in which a bladder is contained within a housing chamber in which both contain liquids. When the housing reservoir is filled, the bladder is squeezed thereby expelling the liquid contained therein.

There are many patents disclosing liquid transfer systems, i.e., for example, U.S. Pat. Nos. 8,186,817 and 6,733,252. Such patents disclose functional sites and conduit strategies, as well as transfer stations, but provide few details of the pumping equipment specifications.

SUMMARY OF THE INVENTION

In accordance with the present invention, a pump assembly is provided that contains no structural components capable of retaining significant quantities of sediment which restrict or impede free flow of a liquid containing a high solids content. The pump is intended to deliver from inlet conduit to an outlet conduit from 6 percent to up to 18 percent suspended solids, as well as carrying up to an additional load of 10 percent dissolved solids. The pump is particularly suited for applications requiring intermittent pumping action, but in one embodiment may be applied to substantially continuous flow.

Pumping action is provided by a flexible bellows-type chamber, preferably pleated or accordion-like, having a liquid communicating port at one end mounted fixedly within a rigid housing, or frame. Flexibility of the chamber is a property of the materials from which it is made, an elastomeric plastic or rubber. The opposite end of the chamber is attached to a plate adapted for slidable movement within the housing. Extension and retraction of the bellows is effected by a reciprocating drive means attached by a rigid piston shaft to the slidable plate, powered to expand or contract the bellows. In one embodiment a double chambered air cylinder contains an air pressure-responsive moveable disk situated perpendicular to the sides of the cylinder in air sealing engagement, thus defining the two chambered cylinder. A piston shaft is attached horizontally, parallel to the sides of the cylinder, to the disk at one end, and attached to the slidable plate of the bellows-type chamber at the opposite end. Application of air pressure to one cylinder chamber or the other, respectively, causes alternately forward or aft reciprocally actuated movement of the piston shaft, thus drawing into or expelling liquid from the bellows chamber. In a second embodiment, reciprocating motion of the bellows to fill or empty the bellows chamber can be attained by employing a reversible electric motor-driven gear assembly and piston shaft similarly configured. For heavy duty applications requiring force to operate the bellows chamber, a non-compressible fluid such as hydraulic fluid can be substituted for air.

Directionally-committed flow of liquid into and out of the bellows chamber is regulated by two flexible tubular pinch-type valves. The first such valve is connected to a source of liquid feedstock, conveyed by a feed conduit. The exit port of the valve is connected flowably to the communicating port of the bellows chamber. When the valve is open, and the bellows activated for extension, liquid from the feed conduit is drawn into the bellows chamber through the first pinch-type valve. To propel the liquid from the filled bellows chamber into a destination conduit, the first valve operable by pneumatic means, is closed, a second flexible tubular pinch-type valve having substantially the same configuration as the first such valve, also flowably connected to the same communicating port of the bellows chamber, is opened to coincide with activation of the bellows chamber for contraction.

Pump cycles are timed and coordinated by programmed control means, typically a computer or micro-processor. By such means both operation of pinch-type valves and the reciprocating drive means are tightly controlled and coordinated by virtually instantaneous electronic signals. In actual practice, however, such timing and coordination are not perfectly reliable because the physical components of the pump are not quite as instantly responsive as the electronics would dictate, principally the result of very short delays in opening of the pinch-type valves. Therefore, it was found that physical intervention means is needed to align pump cycles through physical feedback independent of the programmed control means.

In one embodiment of the intervention means, a pair of limit switches is mounted at the furthest extension and retraction positions of the bellow-type chamber. In the event that the computer has "timed out" a particular phase of the pump cycle, but the limit switch has not been tripped, the cycle is extended momentarily until physical completion of this phase is confirmed by electrical contact in the switch circuit. In this way, the switch signal overrides timing and allows the bellows to complete its cycle then in progress.

In a second embodiment, a mechanically operated quick pneumatic relief valve having inlet and exhaust ports is mounted to the tubular pinch-type valves. The relief valve connects the actuating pneumatic inlet port thereof to a pneumatic inlet port activating the tubular pinch-type of the operable pneumatic means. The relief valve senses by a pressure drop when the air pressure has been terminated, and allows virtually instantaneous exhaust through the relieve valve exhaust port, thereby resulting in a correspondingly virtually instantaneous opening of the pinch-type valve. Preferably the quick relief valve is a membrane type valve and exhausts back pressure upon cessation of positive pneumatic pressure applied through the inlet port. According to empirical evaluation, limit switch intervention alone relieves about 90 percent of the noted discrepancy in fluid delivery; the relief valve intervention nearly all the discrepancy. It appears to add beneficial performance enhancement to utilize both embodiments simultaneously.

The pump of the present invention is intended to be used primarily in intermittent pump cycles, and it is a principal object of the invention to provide a pump free from clogging caused by settling of suspended solids between pump cycles. However, the present pump can be adapted for substantially continuous flow by providing two facing pump units configured as summarized above utilizing a single reciprocating mechanical drive. In this embodiment the piston shaft is operable at both ends with each end being attached to the slidable plate of each unit. Thus, one bellows-type chamber evacuates liquid on the down stroke while simultaneously filling a second bellows-like chamber on its corresponding up stroke.

DETAILED DESCRIPTION OF THE PREFERRED EMBODIMENT

Figure 1:
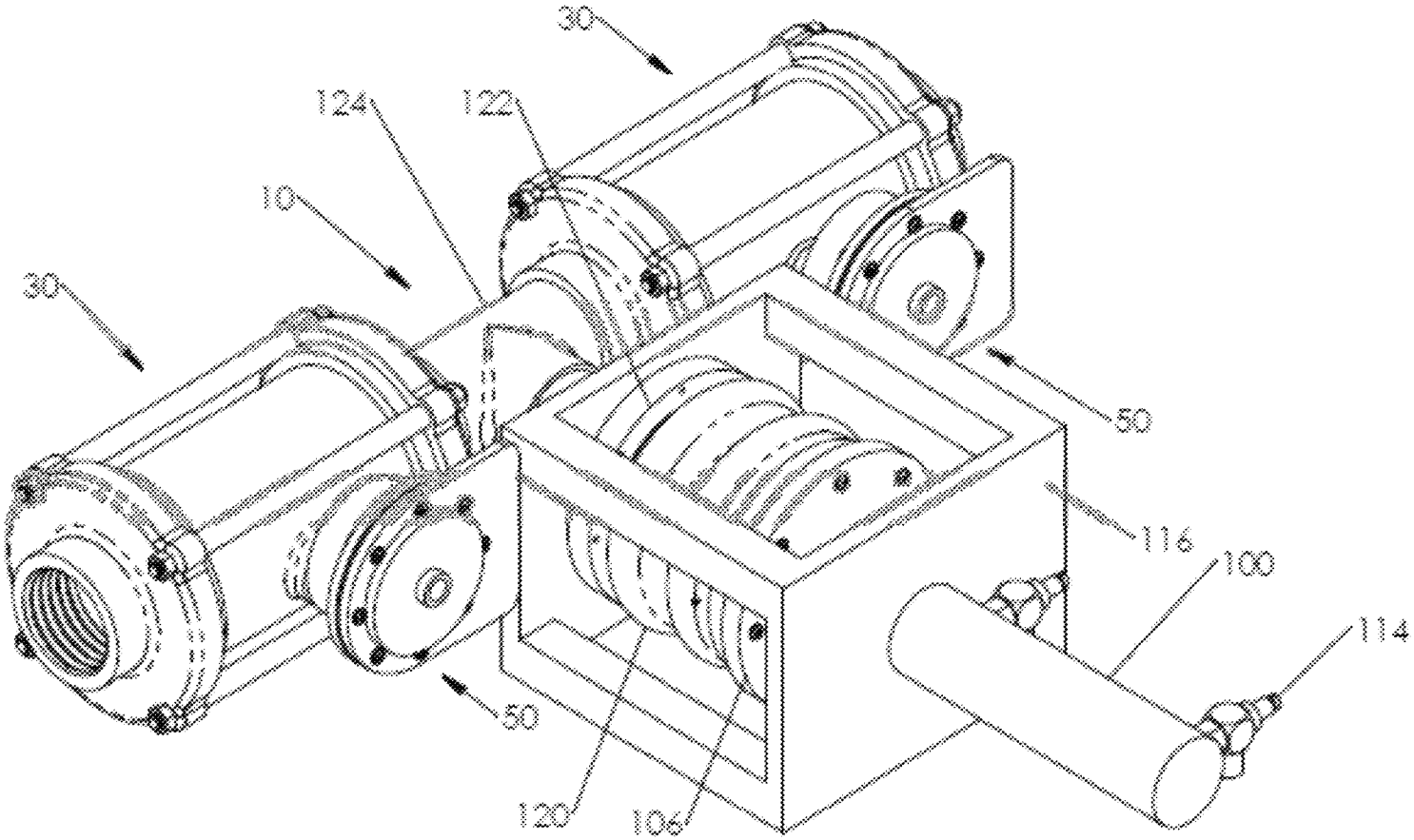
FIG. 1 is a perspective view of the pump components fully assembled as they appear from the exterior.

The conveyance of liquids containing substantial content of sedimentary suspended solids is daunting because the solids tend to settle out and adhere to internal moving parts of the pump and clog its action. In the present invention, the pump components are characterized in having smooth, even surfaces that prevent adherence or entrainment of sediment, and provides accurate volume control of the liquid being dispensed. FIG. 1 illustrates the gross exterior structures of the instant pump components. In its preferred embodiment, the pump comprises a flexible pleated bellows-type chamber 120 enclosed within a frame or housing 116, anchored at one end to a mounting plate or the wall of the frame 122, and at the other end to a plate 106 adapted for slidable reciprocal movement within the housing or frame. The pleated feature of the bellows is important for proper filling and evacuation of the chamber; a straight walled structure crimps and is not suitable. However, note that at its point of furthest extension, the bellows is straight-walled at every pump cycle preventing entrainment of sediment.

The bellows-type chamber 120 is connected flowably through a manifold, generally 10, to two flexible tubular pinch-type valves 30. The configuration of the manifold 10 is not critical, provided that it connects both the pinch-type valves 30 to the bellows chamber 120. In FIG. 1, it is shown in a "T" conformation 124.

A reversible or reciprocating drive means 100, attached to the end plate 106, passes through the housing or frame 116. It is preferably a pneumatic or hydraulic device having air or hydraulic fluid entry ports 114, but may be a motorized gear-driven assembly.

Finally, the tubular pinch-type valves 30 are provided with physical intervention means, in this embodiment a mechanically operated pneumatic relief valve 50 to ensure rapid release of air pressure within the pinch-type valves 30. This is essential for virtually instantaneous opening of the valves 30 to maintain pumping volume at precise disbursement rates.

Figure 2:
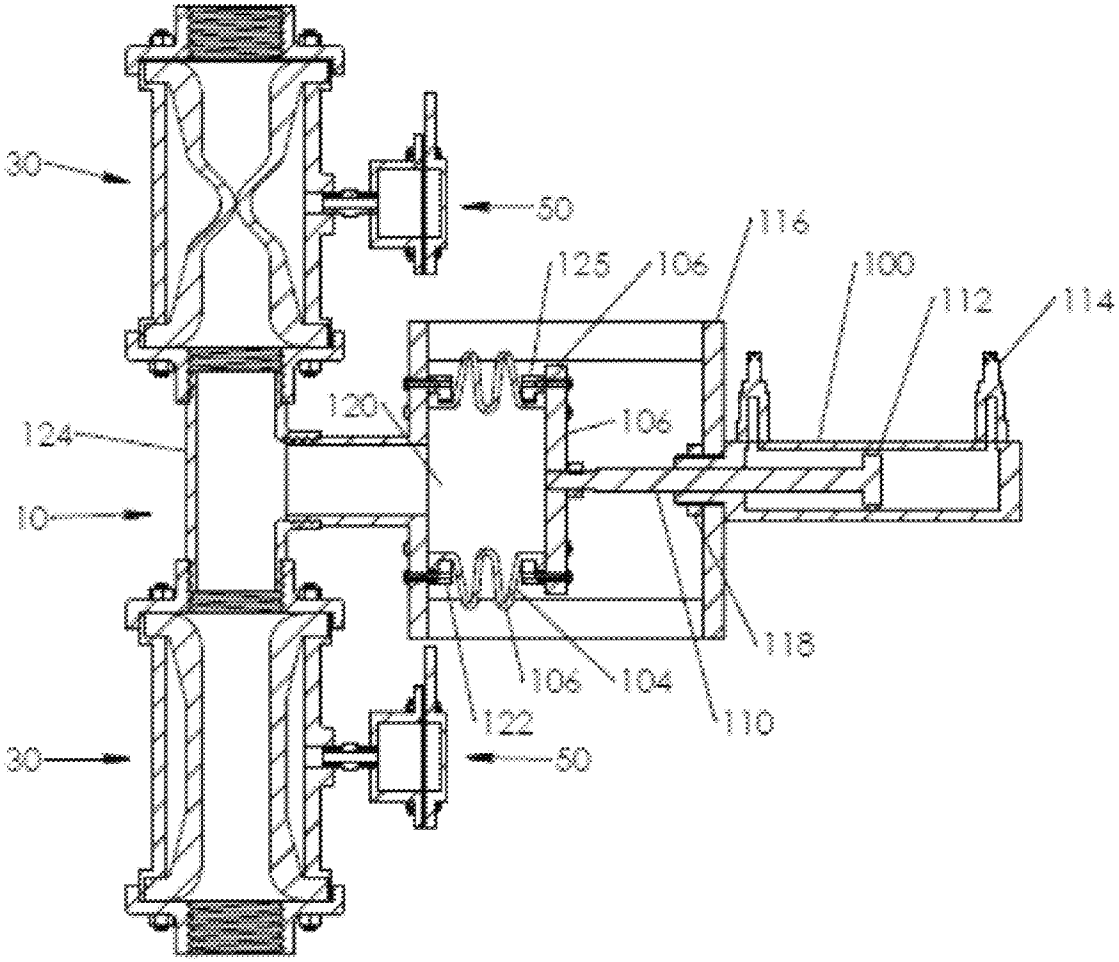
FIGS. 2 and 3 are cross-sectional views of the internal structure of pump parts, and further illustrate partially retracted (FIG. 2) and extended (FIG. 3) positions of the bellows chamber.
Figure 3:
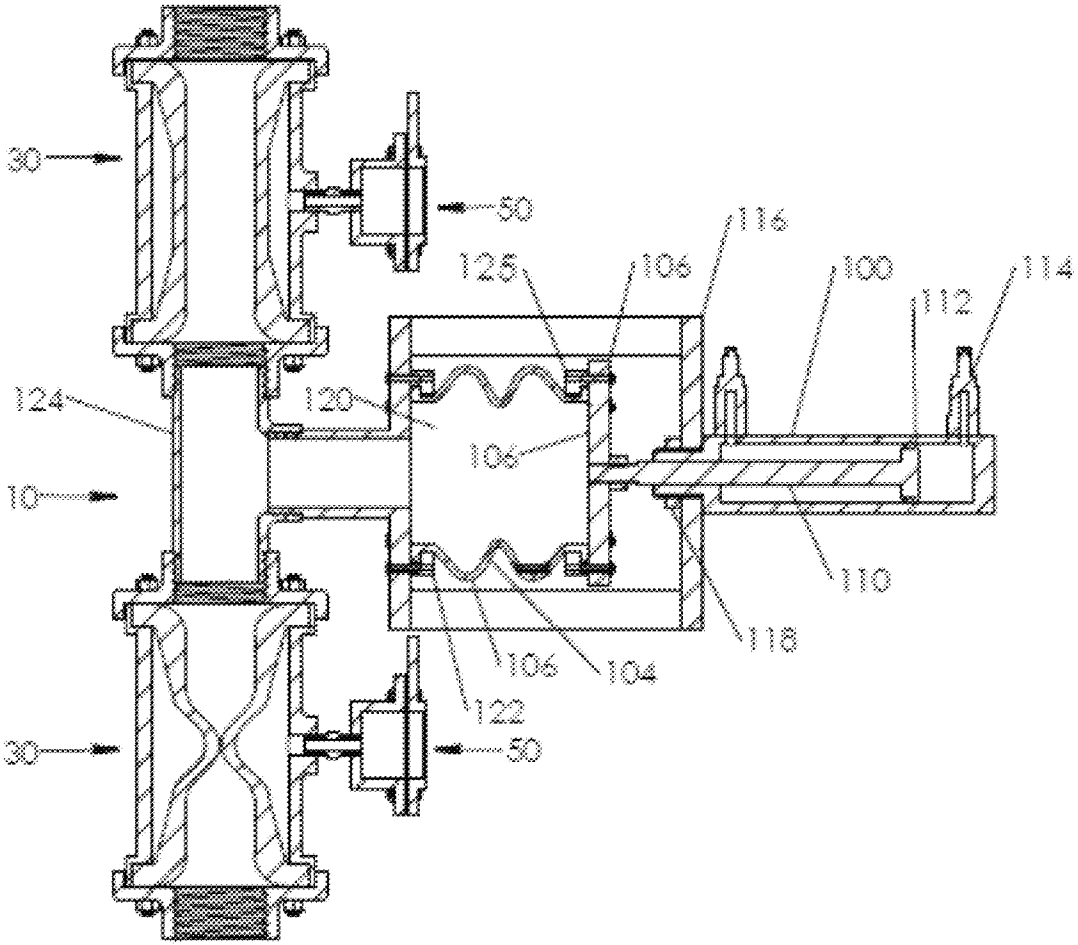

FIGS. 2 and 3 show cross-sectional views of the pump in which the bellows-like chamber is depicted partially retracted and extended respectively. The cross-sectional view particularly reveals the structure of the preferred pneumatic or hydraulic reciprocating drive means, an air cylinder having a pressure responsive moveable disk 112 integral (as shown) to a rigid piston shaft 110. When air pressure is applied at inlet port 114, the moveable disk 112 is displaced, moving in retraction mode. Correspondingly, the slidable plate 106 attached to the rigid piston shaft 110, is displaced a commensurate distance, thereby retracting the bellows-type chamber. The opposite action occurs when pressure is applied at the other inlet on the opposite side of the moveable disk 112. The moveable disk 112 is displaced outwardly in extension mode of the bellows. It is advantageous that the inner wall of the air cylinder 100 be lubricated or lined with a material having a low frictional coefficient, so that the moveable disk moves bi-directionally with ease; but not so loose fitting as to cause a leak of air or hydraulic fluid from one air chamber to the other during forward and aft movement of piston shaft 110.

Figure 4B:
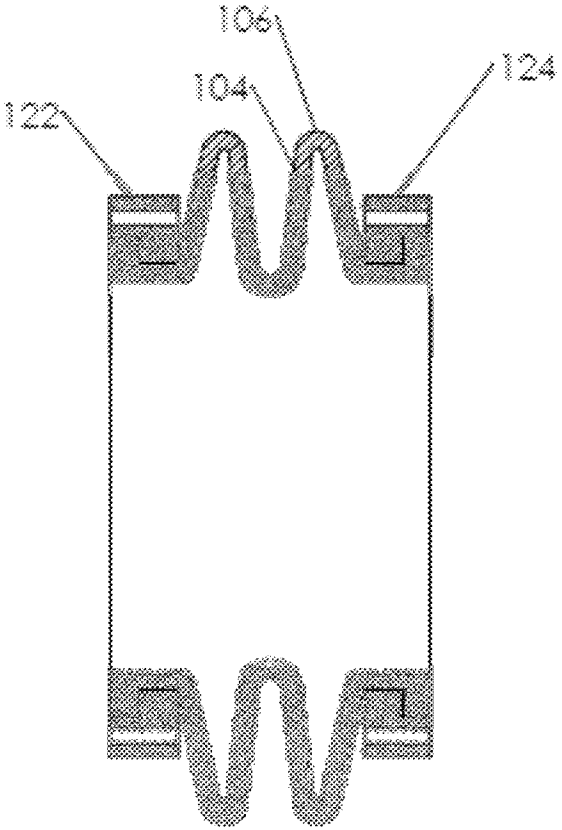
FIGS. 4A and 4B are planar enlargements of the bellows feature in extended and retracted positions, respectively.
Figure 4A:
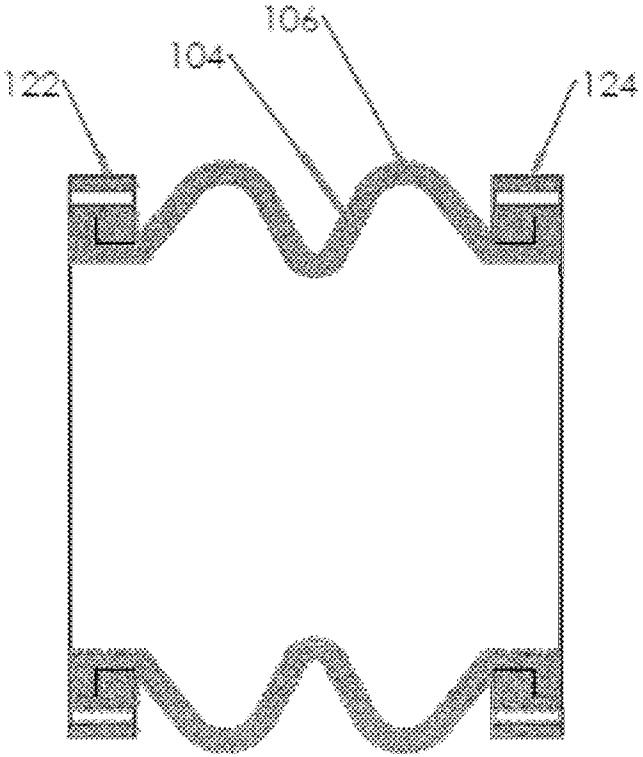
Figure 5A:
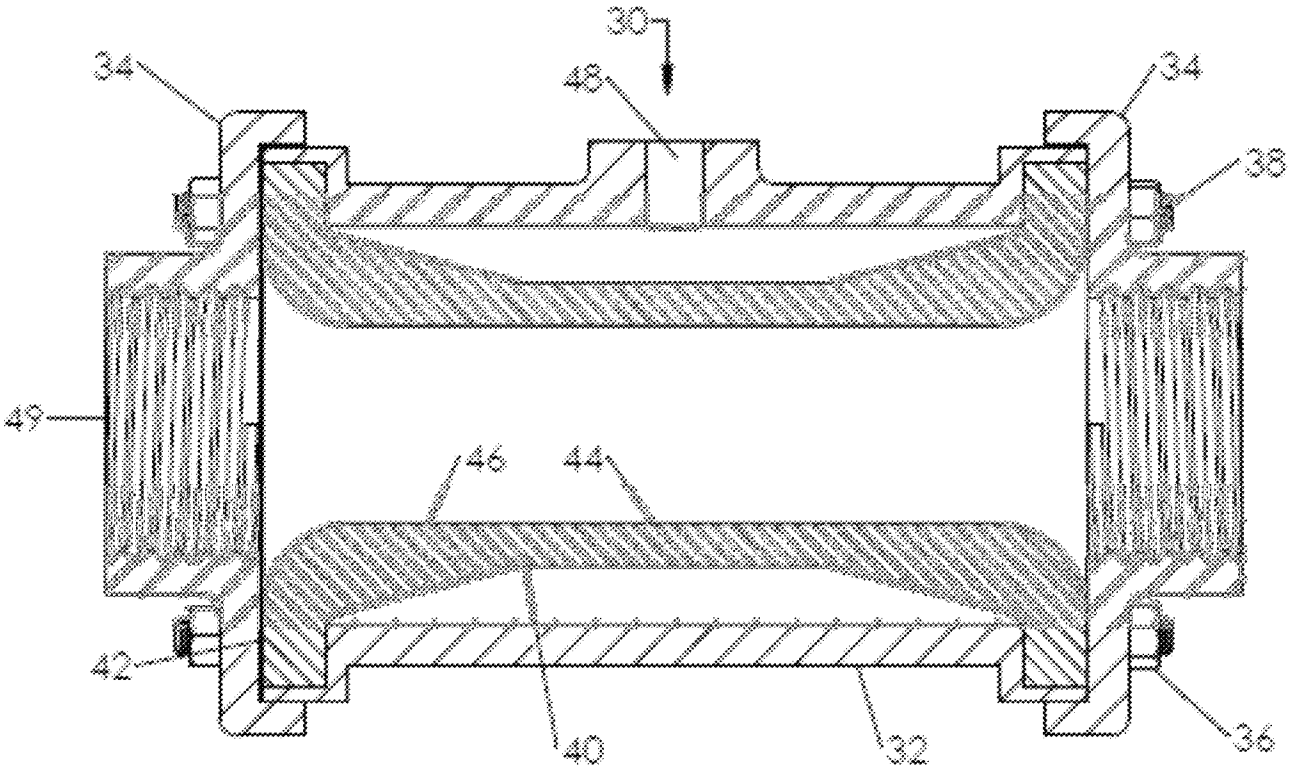
FIGS. 5A and 5B are planar enlargements of the flexible tubular pinch-like valves in open and closed states.
Figure 5B:
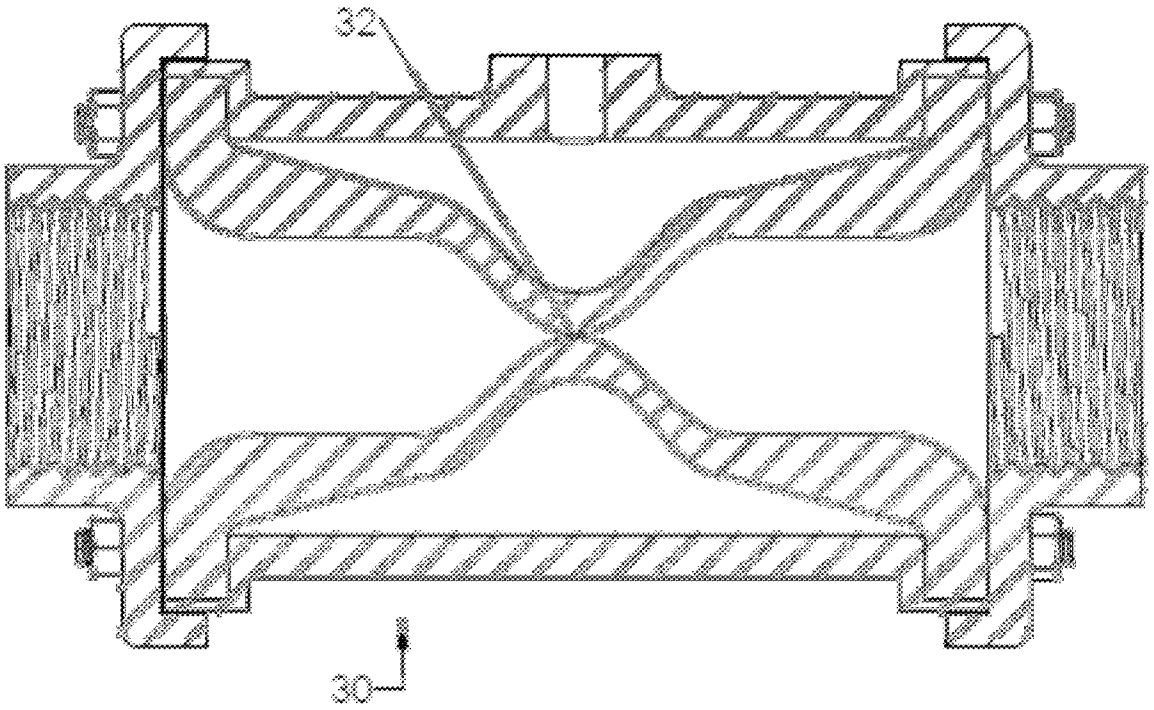

The flexible bellows like chamber is secured in place at its ends by concentric fastening means 122 such as a pressure seal 125. The pleated accordion-like structure of the chamber facilitates retraction and extension thereof by having natural fold lines. Referring to FIGS. 4A and 4B, the structure of the pleated chamber is shown in greater detail. The pleat has an apex 106 and a sloping portion 104. When the pleat is compressed the distance between the folds decreases. At full compression the sloping portions 104 merge with liquid therebetween being squeezed into the chamber. Sediment has no structure upon which to be deposited; and plugging is prevented. Thus, there are two points in the pumping cycle, namely, at the point of full extension (a straight wall) and at the point of full retraction when retention of a solids residue is obviated FIGS. 5A and 5B are enlarged views of the tubular pinch-type valve in its open and closed positions respectively. The valve comprises a housing in two parts, a body portion 32, and two end caps 34, shown threaded 49, to receive a threaded conduit, a flexible membranous liner 44, and in this embodiment a series of restraining bolts to hold the pieces together. The membrane liner 44 is shown tethered concentrically at either end at a recess groove in body portion 42. The wall of the housing has an air inlet port 30 having an aperture 48 at its center, for ingress of pressurized air and also serves as an exhaust port. When air pressure is applied, the flexible membrane stretches inwardly (FIG. 5B) until it converges at a center point 32, thus providing an effective barrier to flow of liquid within the valve. The membrane may vary in thickness 46 from the perimeter to the center to favor convergence at the center. It is significant that when the valve is open during passage of liquid, there is no moving part in the body portion or other obstruction at which sediment can collect and plug or impede flow.

The electronic control means is capable of instantaneously sending a signal opening one valve and closing the other, and coordinating the pumping action of the bellows-like chamber with valve action. Typically, valve action is mediated by a solenoid valve that gives the pinch-type valves access to air pressure. Conventionally, a vent tube is run from the pinch-type valve to one of the solenoid stations vented to atmosphere, thus relieving pressure within the tubular chamber, and opening the valve. It was discovered empirically that venting by this method is too slow, so there is delay (however momentary) in opening a valve. This means that on the inlet side, the pump "times out" before the bellows is completely filled; and on the outlet side, the bellows is pumping against a closed circuit. The result is starving the flow of liquid to its destination. The computer notes a liquid volume greater than has actually been delivered.

Figure 6A:
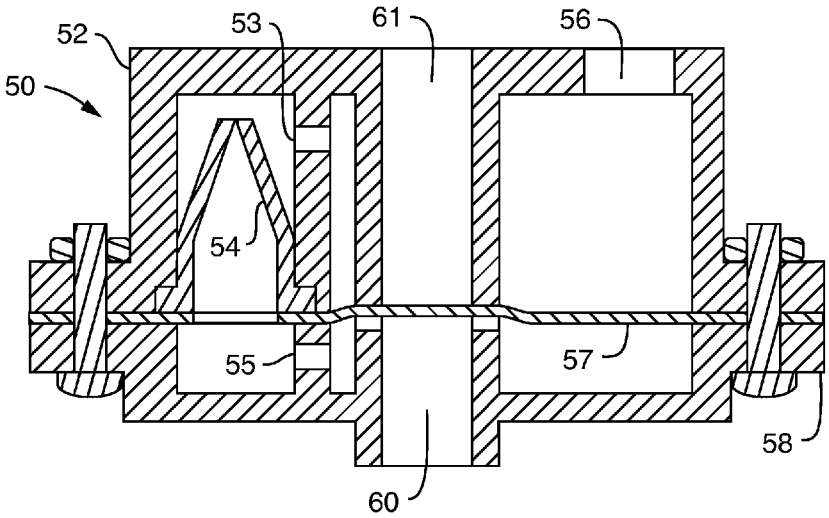
FIGS. 6A and 6B are cross-sectional views of the quick relief valve in closed and open positions, respectively.
Figure 6B:
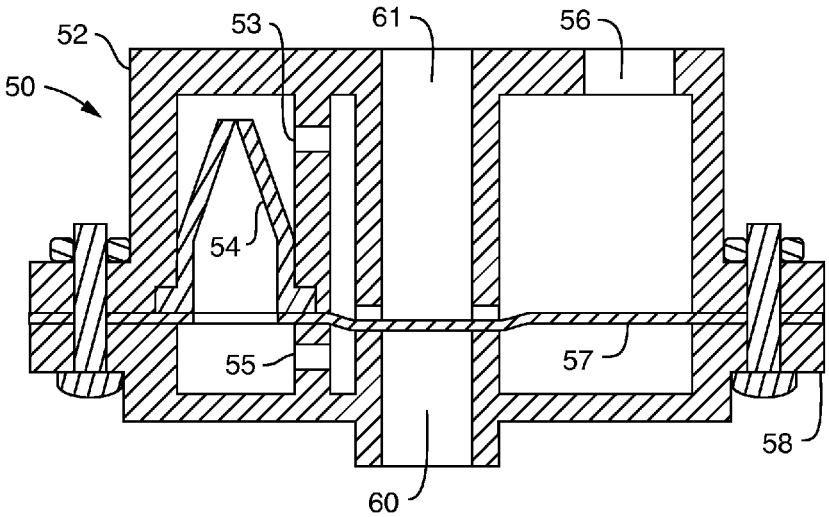

It was found that a quick relief valve mounted on the pinch-type valve solves this problem in addition to inclusion of limit switches as described above. FIGS. 6A and 6B illustrate the quick relief valve of the preferred embodiment, although many other valve configurations may be available commercially and more or less be substituted for this particular one. FIGS. 6A and 6B illustrate a quick release valve (generally 50) having essentially two chambers separated by a moveable membrane 57. FIG. 6A shows the valve in closed position. The valve is contained within a housing 52. A source of pressurized air is connected flowably to an entry port 60 and flows through an aperture 55 into a left chamber. Air is then directed through a duckbill valve 54 into an upper chamber, which vents through an upper port 53 to a right upper chamber. The entry port 60 circular conduit passing through the center, the top portion (above the moveable membrane 57) serving as an exhaust port. An exit port 56 is flowably connected directly to the inlet port 30 at its aperture 48. While a short conduit separating the quick relief valve from its corresponding pinch-type valve is shown in FIGS. 2 and 3, to emphasize the flow pattern, it is desirable to mount the quick relief valve directly on the body of the pinch-type valve to minimize the distance exhaust air must flow to open the valve.

In operation, the quick relief valve receives and transmits pressurized air to a pinch-type valve, thereby closing it. The air pressure also deflects the flexible moveable membrane 57 to form a sealing engagement of the membrane against the upper portion of the entry port 56, thereby blocking escape of air to the exhaust portion of the conduit. When air pressure ceases, the back pressure of air already contained in the pinch-type valve closes it, deflects the membrane downward to allow air to escape through the exit portion of the entry port 56. Thus, the opening of the valve is physically and functionally defined independently of computer timing instructions. This has a profound and somewhat surprising effect on normalizing flow volume between pump cycles. In combination especially with the limit switch feature, it virtually eliminates all aberrant flow.

Figure 7:
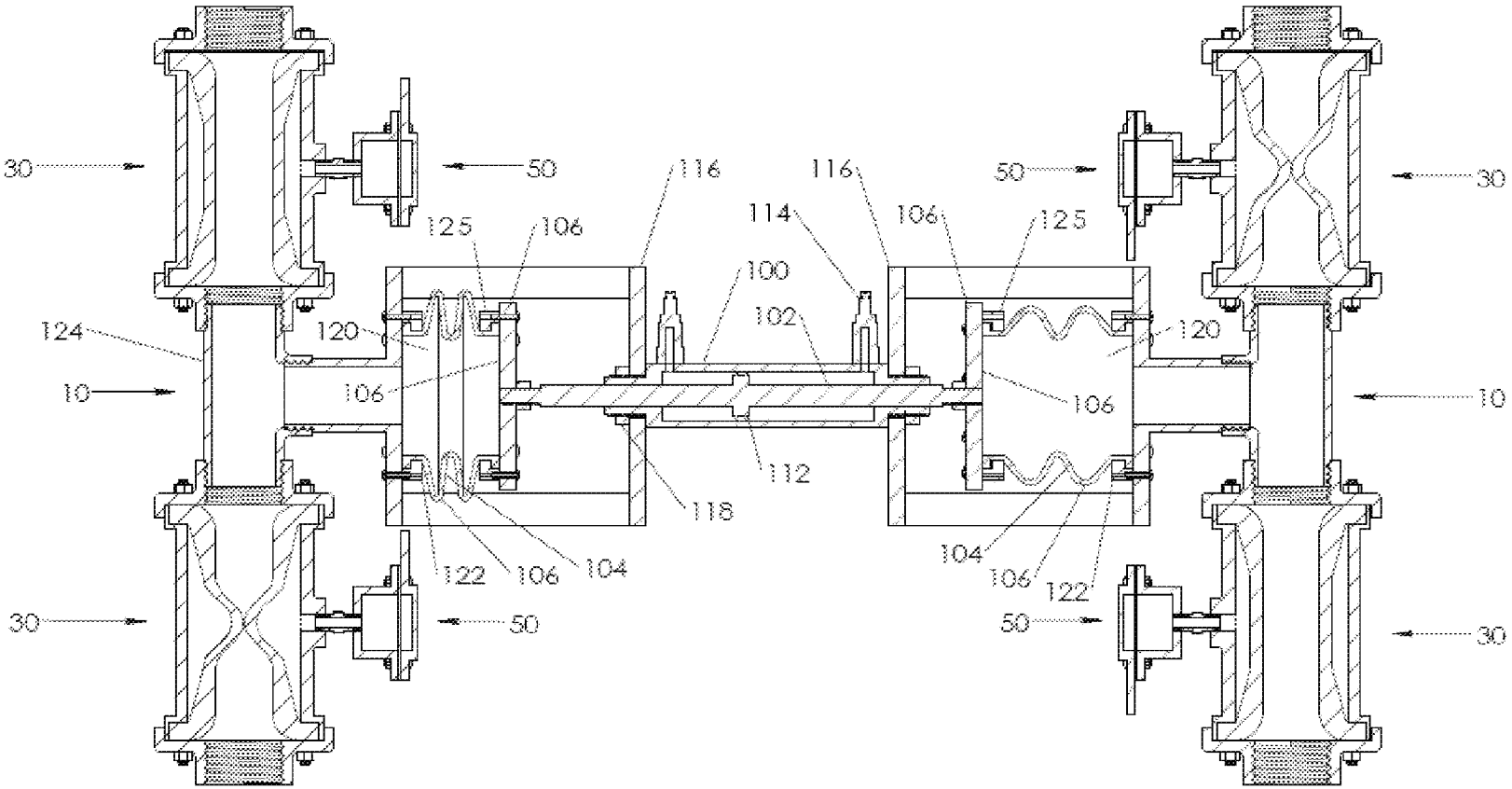
FIG. 7 is a cross-sectional view of an embodiment of the pump in continuous flow or dual flow configuration.

Although the pump of the present invention is primarily intended for discontinuous intermittent pumping cycles, the pump can be configured to deliver substantially continuous flow by combining two such units into a solitary device, as shown in FIG. 7. The two units face each other in presenting the bellow-type chamber apparatus, and share a common reciprocating drive means. All parts are identical and conform to drawing previously presented herein. The difference is that the drive means is adapted to bi-directional movement by extending the rigid piston shaft 102 so that it engages and is attached to the slidable plate of the bellows-like chamber of both units. In addition to providing substantially continuous pumping of identical feedstocks into a common transfer conduit, this device has the following additional advantages: (1) it allows two different feed stocks to be combined; (2) while the length of the pump stroke is fixed, the diameter is not, and therefore different proportions of two different feed stocks can be admixed; and (3) using the same integrated reciprocating drive means for two different pumps allows diversion of the two exit streams to different destinations.

What is claimed is:

1. A pump for transfer of liquids containing suspended solids comprising a flexible bellows having a liquid communicating port at one end mounted fixedly within a rigid housing and mounted at the opposite end to a plate adapted for slidable reciprocal movement within the housing, wherein said bellows is fillable with said liquids containing suspended solids via said liquid communicating port, reciprocating drive means attached to the slidable plate to effect extension and retraction of the bellows, a first flexible tubular pinch-type valve, operable by pneumatic means, connected to said communicating port of the bellows, a second flexible tubular pinch-type valve having the same operating configuration as the first valve, first and second mechanically operated quick pneumatic relief valves having inlet and exhaust ports that exhaust directly to the atmosphere, said valves mounted on said two tubular pinch-type valves respectively and connected via the actuating pneumatic port of the pneumatic quick relief valve to a pneumatic inlet port thereby activating said tubular pinch-type valve; and programmed control means for electronic timing and coordinating the operation of the pinch-type valves and reciprocating drive means.

2. The pump for transfer of liquids containing suspended solids of claim 1 wherein said reciprocating drive means is a piston shaft attached horizontally to the slidable plate of the bellows, reciprocally actuated by pneumatic pressure alternately from a pressure chamber, or by an electric motor-driven gear assembly and shaft similarly configured to provide extension and retraction movement to the bellows.

3. The pump for transfer of liquids containing suspended solids of claim 1 wherein said quick pneumatic relief valve is a membrane type valve and exhausts back pressure air upon cessation of positive pneumatic pressure being applied through the inlet port of the quick pneumatic valve resulting in instantaneous opening of the pinch-type valve.

* * * * *